United States Patent [19]

Taggi et al.

[11] Patent Number: 4,794,066

[45] Date of Patent: Dec. 27, 1988

[54] PROCESS FOR PREPARATION OF LIQUID ELECTROSTATIC DEVELOPER

[75] Inventors: Arthur J. Taggi, Hockessin; Torence J. Trout, Wilmington, both of Del.

[73] Assignee: E. I. Du Pont de Nemours and Company, Wilmington, Del.

[21] Appl. No.: 116,657

[22] Filed: Nov. 4, 1987

[51] Int. Cl.[4] ..... G03G 9/12

[52] U.S. Cl. ..... 430/137; 51/323

[58] Field of Search ..... 430/137; 106/23, 288 Q; 51/323, 325

[56] References Cited

U.S. PATENT DOCUMENTS

| | | | |
|---|---|---|---|
| 4,032,357 | 6/1977 | Rees et al. | 106/288 Q |
| 4,400,216 | 8/1983 | Arora | 106/23 |
| 4,411,976 | 10/1983 | Landa et al. | 430/114 |
| 4,413,048 | 11/1983 | Landa | 430/115 |
| 4,631,244 | 12/1986 | Mitchell | 430/137 |

FOREIGN PATENT DOCUMENTS

| | | |
|---|---|---|
| 54-28141 | 3/1979 | Japan . |
| 60-39229 | 9/1985 | Japan . |
| 2169416A | 7/1986 | United Kingdom . |

*Primary Examiner*—John L. Goodrow

[57] ABSTRACT

Improved liquid electrostatic developer containing electrostatic toner particles is prepared by a process wherein an aqueous, e.g., water-wet pigment cake is flushed with a water insoluble vehicle, water is removed, and the developer is formed from the flushed pigment dispersion, thermoplastic resin, dispersant nonpolar liquid having a Kauri-butanol value of less than 30, in a vessel at elevated temperature under high shear, and the dispersion is cooled. The liquid electrostatic developer is useful in copying, making proofs including digital color proofs, lithographic printing plates, and resists.

31 Claims, No Drawings

PROCESS FOR PREPARATION OF LIQUID ELECTROSTATIC DEVELOPER

DESCRIPTION

TECHNICAL FIELD

This invention relates to a process for preparation of an improved liquid electrostatic developer. More particularly this invention relates to a process whereby the liquid electrostatic developer is prepared from pigment prepared by a flushing procedure.

BACKGROUND ART

The development of a latent electrostatic image with a liquid electrostatic developer and transfer of the developer to a carrier sheet where the image is fixed by heating is known. For example, Landa et al. U.S. Pat. No. 4,411,976 describes a method of transferring a liquid-developed electrostatic image across a gap to a carrier sheet and raising the temperature up to 100° C. to solvate binder which surrounds a pigment in the developer and thereby spread the transferred image to form areas of the image which are dense. Landa U.S. Pat. No. 4,413,048 describes resinous-toner particles, e.g., polymer encased pigment particles, together with spacer particles incorporated within a nonpolar liquid, e.g., low boiling aliphatic hydrocarbon. These and other patents describe pigments coated with various polymers, resins, and waxes and dispersed in a nonpolar liquid to serve as liquid developers. Japanese Patent Publication No. 60-39229 published Sept. 5, 1985 describes a liquid developer for electrostatic imaging wherein the colorant, e.g., a combination of colored pigment and carbon black is dispersed with a composition of a specifically defined binary or ternary copolymer and a waxy substance of polyolefin having a softening point of 60° to 130° C. The colorant is carbon black or preferably carbon black and an organic pigment in cake form containing water treated by flushing, i.e., replacement of the water present by a resin solvent solution. The water and resin solvent are subsequently removed and the lumps of resin coated pigment material are pulverized to form fine powder of flushed pigment. A resin dispersion is prepared from binary or ternary copolymers obtained from the polymerization of acrylate monomers in aliphatic hydrocarbon liquid in the presence of a waxy substance or polyolefin. The flushed pigment, a resin dispersion as defined, and a nonaqueous solvent are then dispersed in a high shear mixing device to break up agglomerates and form the liquid developer.

It has now been found that an improved liquid electrostatic developer can be prepared using a flushing technique for preparing pigment without need for special resins. The images formed using the liquid electrostatic developer by this process have improved image quality manifested by reduced squash, improved resolution, and improved transfer efficiency.

DISCLOSURE OF THE INVENTION

In accordance with this invention there is provided a process for preparing an improved liquid electrostatic developer containing electrostatic toner particles comprising (a) mixing intimately a water-wet presscake pigment with at least one water insoluble vehicle in the absence of a solvent for the water insoluble vehicle until water separates from the mixture leaving the pigment dispersed in the water insoluble vehicle;

(b) removing substantially all the water;

(c) dispersing at an elevated temperature in a vessel under high shear the pigment dispersion, a thermoplastic resin, a nonpolar liquid having a Kauri-butanol value of less than 30, the temperature being maintained to plasticize and liquify the resin and below that at which the nonpolar liquid degrades and any component decomposes;

(d) cooling the dispersion to form resin toner particles having pigment dispersed therein.

Throughout the specification the below-listed words or terms have the following meanings:

Flushing means the direct transfer of pigment in an aqueous phase to a water insoluble vehicle without intermediate drying of the pigment. By water insoluble vehicle is meant at least one oil, nonaqueous liquid, resin, or mixtures as more fully described below. For example, an aqueous pigment dispersion is converted to a nonaqueous pigment dispersion such that water separates out as a phase to be removed. In essence, water is flushed out by the water insoluble vehicle. Sequential stages of flushing are:

(1) Phase transfer which means the movement of the pigment from an aqueous phase to a nonaqueous phase;

(2) Water separation which means gathering of the nonaqueous phase into a continuous mass and physical removal of the separated water.

Bulk conductivity is the conductivity of the developer and may be expressed as BULK.

Squash means the flattening of an image resulting in the diminishment of the resolution and sharpness thereof.

The process of this invention results in toner particles adapted for electrophoretic movement through a nonpolar liquid. The toner particles which have excellent color preferably are formed having a plurality of fibers extending from the toner particles. Fibers integrally extending therefrom (alluding to a toner particle) means a pigmented toner particle formed with fibers, tendrils, tentacles, threadlets, fibrils, ligaments, hairs, bristles, or the like.

The toner particles are prepared from at least one thermoplastic polymer or resin, a pigment prepared by flushing, and dispersant nonpolar liquid as described in more detail below. In addition, a nonpolar liquid soluble ionic or zwitterionic compound, a polar additive having a Kauri-butanol value of at least 30, adjuvants, etc., can be present in the preparation of the toner particles.

The pigments used in the liquid electrostatic developer are colored pigments other than black in the form of a water-wet presscake. Suitable pigments include: Heucophthal Blue BT-585-P, Monastral® Blue G (C.I. Pigment Blue 15 C.I. No. 74160), Toluidine Red Y (C.I. Pigment Red 3), Quindo® Magenta (Pigment Red 122), Magenta RV-6831 presscake Mobay Chemical, Harmon Division, Haledon, NJ., Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow YT-839-P (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), etc. Cyan, magenta and yellow pigments are preferred pigments, particularly for proofing purposes. Black pigments, such as carbon black, are not known to form aqueous presscakes and therefore are not included as pigments according to this invention. Fine particle size oxides, e.g., silica, alumina, titania, etc.; preferably in the order of 0.5 μm or less can be dispersed into the liquified resin in combination with the pigments.

The pigments in presscake form undergo flushing with a water insoluble vehicle until water in the presscake separates from the mixture formed leaving the pigment dispersed in the water insoluble vehicle. Generally this is accomplished by mixing intimately in a suitable vessel the water-wet presscake and the water insoluble vehicle without addition of a solvent for the water insoluble vehicle. It is desirable that no agglomeration of the pigment occur during dispersion in the water insoluble vehicle. Flushing techniques are described in the Procedures set forth below, but the invention is not limited to the type of flushing described in the Procedures since other flushing procedures known to those skilled in the art are also useful. In addition, commercially available flushed pigments may be used in the invention. Without being limited commercial flush pigments include, for example, polyethylene flushes, e.g., AAOT Yellow 14, AAOA Yellow 17, AADMCA Yellow 83; Red Lake C (C.I. Pigment Red 53:1), Red 2B-Blue Shape (C.I. Pigment Red 48:2), Bon Red (C.I. Pigment Red 52), Phthalocyanine Blue (C.I. Pigment Blue 15:1), Phthalocyanine Blue (C.I. Pigment Blue 15:3), Phthalocyanine Green (C.I. Pigment Green 7), Dianisidine Orange (C.I. Pigment Orange 16) all manufactured by Sun Chemical Co., Cincinnati, OH; oil flushes, e.g., alkali blue triarylmethane blue (C.I. Pigment Blue 61); Barium Lithol® Bon-Red (C.I. Pigment Red 49:1), Fanal® Methyl Violet (C.I. Pigment violet 3:3), Heliogen Blue® Copper-Phthalo Cyanine (C.I. Pigment Blue 15:3), Lithol® Bon-Rubine 4B (C.I. Pigment 57:1), Red Lake C Pigment Bon-Red C (C.I. Pigment 53:1), Sico® Yellow Diarylide, C.I. Pigment Yellow 12, all manufactured by BASF Wyandotte Corp., Holland, MI, etc.

Examples of useful water insoluble vehicles which are compatible with the nonpolar liquid of the liquid electrostatic developer include: nonaqueous liquids such as nonpolar liquids, e.g., those hydrocarbons described below as the dispersant liquid in the liquid electrostatic developer, polar liquids having a Kauri-butanol value greater than 30, determined by ASTM D 1133, e.g., cyclohexane, kerosene, Aromatic 100, a high purity aromatic solvent which is a mixture of $C_9$ and $C_{10}$ alkyl-substituted benzenes having a Kauri-butanol value of 91, manufactured by Exxon Corporation; benzene, toluene, substituted benzene and naphthalene compounds, e.g., trimethylbenzene, xylene, dimethylethylbenzene, ethylmethylbenzene, propylbenzene, etc.; oils such as mineral oil, e.g., that sold under the trademark of Nujol® mineral oil, Schering-Plough Corporation, Mabelline, CO; liquid paraffins including saturated or unsaturated paraffins which are liquid-like at room temperature, e.g., Unico® type liquid paraffins manufactured by Union Oil Co., Crystol® type liquid paraffins manufactured by Exxon Corp.; anhydrous lanolin, linseed oil, petrolatum, etc.; and compatible mixtures of nonaqueous liquids and oils.

Additional water insoluble vehicles include resins or mixtures of resins, e.g., thermoplastic resins as described below, paraffin waxes, e.g., Microcrystalline® Wax (Mobil Oil Co.), Shell Paraffin Wax (Shell Oil Co.), polyolefin wax, triglyceride wax, natural wax, polyethelene waxes, e.g., Epolene® E Series, Eastman Chemical Products, Inc., Kingsport, TN; carnuba wax, beeswax, ethylene-propylene copolymer waxes, long-chain petroleum waxes, amide waxes, Carbowax® polyethylene glycol, Santowax®, mixed o-, n- and p-terphenyl, etc. The resins can be mixed with either oil, nonaqueous liquid or both with the proviso that the oil and nonaqueous liquid are not solvents for the resin.

The pigment dispersed in at least one water insoluble vehicle described above, after removal of substantially all the water present, is dispersed at an elevated temperature in a vessel under high shear in the presence of a thermoplastic resin, a dispersant nonpolar liquid having a Kauri-butanol value of less than 30 and other additives. The dispersion is subsequently cooled and a liquid electrostatic developer is prepared having resin toner particles having flushed pigment dispersed in said resin particles. The toner particles in the liquid electrostatic developer, which preferably have a plurality of fibers extending therefrom, have an average by area particle size of less than 10 μm, preferably the average by area particle size is less than 5 μm.

The liquid electrostatic developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media for dispersing and grinding, Ross double planetary mixer manufactured by Charles Ross and Son, Hauppauge, NY, etc., are placed the above-described ingredients. Generally the resin, dispersant nonpolar liquid and flushed pigment are placed in the vessel prior to starting the dispersing step although after homogenizing the resin and the dispersant nonpolar liquid the flushed pigment can be added. The dispersing step is generally accomplished at elevated temperature, i.e., the temperature of ingredients in the vessel being sufficient to plasticize the liquefy the resin but being below that at which the dispersant nonpolar liquid degrades and any component, e.g., the resin and/or pigment decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are, for example, spherical, cylindrical, etc. selectected from the group consisting of stainless steel, carbon steel, alumina, ceramic, zirconium, silica, and sillimanite. A typical diameter range for the particulate media is in the range of 0.04 to 0.5 inch (1.0 to ~13 mm).

After dispersing the ingredients in the vessel until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with particulate media in the presence of additional liquid to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin solidifies or precipitates out of the nonpolar liquid during the cooling. Toner particles of average particle size (by area) of less than 10 μm, as determined by a Horiba CAPA-500 centrifugal particle analyzer described below, are formed by grinding for a relatively short period of time.

Another instrument for measuring average particle sizes is a Malvern 3600E Particle Sizer manufactured by Malvern, Southborough, MA which uses laser diffraction light scattering of stirred samples to determine average particle sizes. Since these two instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional nonpolar liquid as described previously above. The dilution is conducted to reduce the concentration of toner particles to between 0.1 to 5 percent by weight, preferably 0.5 to 2 weight percent with respect to the nonpolar liquid. One or more nonpolar liquid soluble ionic or zwitterionic compounds can be added to impart a positive or negative charge, as desired. The addition may occur at any time during or after step (c) of the process. If a diluting nonpolar liquid is also added, the ionic or zwitterionic compound can be added prior to, concurrently with, or subsequent thereto.

Examples of the primary ingredients that are used in preparing the liquid electrostatic developer are:

(1) thermoplastic resins or polymers in the form of toner particles with the pigment: ethylene vinyl acetate (EVA) copolymers (Elvax® resins, E. I. du Pont de Nemours and Company, Wilmington, DE), copolymers of ethylene and an α,β-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylic series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, DE, etc. Preferred copolymers are the copolymer of ethylene and an α,β-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid Number is milligrams potassium hydroxide required to neutralize 1 gram of polymer. The melt index (g/10 min) of 10 to 500 is determined by ASTM D 1238, Procedure A. Particularly preferred copolymers of this type have an acid number of 66 and 60 and a melt index of 100 and 500 determined at 190° C., respectively.

In addition, the resins have the following preferred characteristics:

1. Be able to disperse the pigment, metallic soap, etc.
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 5 μm, in diameter (preferred size), e.g., determined by Horiba CAPA-500 centrifugal particle analyzer; and between about 1 μm and 15 μm, in diameter, e.g., determined by Malvern 3600E Particle Sizer as described above,
5. Be able to form a particle (average by area) of less than 10 μm, e.g., determined by Horiba CAPA-500 centrifugal automatic particle analyzer, manufactured by Horiba Instruments, Inc., Irvine, CA: with instrument settings of solvent viscosity of 1.24 cps, solvent density of 0.76 g/cc, sample of density of 1.32 using a centrifugal rotation of 1,000 rpm, a particle size range of 0.01 to less than 10 μm, and a particle size cut of 1.0 μm, and, about 30 μm average particle size, e.g., determined by Malvern 3600E Particle Sizer as described above,
6. Be able to fuse at temperatures in excess of 70° C.

By solvation in 3. above, the resins forming the toner particles will become swollen or gelatinous.

(2) Nonpolar liquids: branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C., Isopar®-M between 207° C. and 254° C. and Isopar®-V between 254.4° C. and 329.4° C. Isopar®-L has a mid-boiling point of approximately 194° C. Isopar ®-M has a flash point of 80° C. and an auto-ignition temperature of 338° C. Stringent manufacturing specifications limit impurities such as sulphur, acids, carboxyl, and chlorides to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ®12 | 69 | 204 |
| Norpar ®13 | 93 | 210 |
| Norpar ®15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrial volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

(3) Colored pigment in aqueous or water-wet presscake form as described above.

Preferably a nonpolar liquid soluble ionic or zwitterionic compound is present. These compounds are known in the art as agents that control the polarity of the charge on toner particles (charge directors). Examples of such compounds, which are generally used in an amount of 1 to 1000 mg/g, preferably 1 to 250 mg/g developer solids, are positive charge directors, e.g., sodium dioctylsulfosuccinate, zirconium octoate and metal soaps such as copper oleate, etc.; negative charge directions, e.g., lecithin, Basic Calcium Petronate ®, Basic Barium Petronate ®, Neutral Barium Petronate ®, oil-soluble petroleum sulfonates, manufactured by Sonneborn Division of Witco Chemical Corp., New York, NY, alkyl succinimide (manufactured by Chevron Chemical Company of California), etc.

Another additional component of the electrostatic liquid developer is an adjuvant which can be taken from the group of polyhydroxy compound which contains at least 2 hydroxy groups, aminoalcohol, polybutylene succinimide, aromatic hydrocarbon having a Kauri-butanol value of greater than 30, and metallic soap. The adjuvants, other than metallic soap, are generally used in an amount of 1 to 1000 mg/g, preferably 1 to 200 mg/g developer solids. The metallic soap, when present, is useful in an amount of 0.01 to 60 percent by weight based on the total weight of the developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycol monohydroxystearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocrbon, and the remainder oil, etc.

aromatic hydrocarbon: benzene, toluene, naphthalene, substituted benzene and naphthalene compounds, e.g., trimethylbenzene, xylene, dimethylethylbenzene, ethylbenzene, ethylmethylbenzene, propylbenzene, Aromatic 100 which is a mixture of $C_9$ and $C_{10}$ alkyl-substituted benzenes manufactured by Exxon Corp., etc.

metallic soap: aluminum tristearate, aluminum distearate, barium, calcium, lead and zinc stearates; cobalt, manganese, lead and zinc linoleates; aluminum, calcium and cobalt octoates, calcium and cobalt oleates, zinc palmitate, calcium, cobalt, manganese, lead and zinc naphthenates, calcium, cobalt, manganese, lead and zinc resinates, etc. The metallic soap is dispersed in the thermoplastic resin as described in Trout U.S. application Ser. No. 857,326, filed Apr. 30, 1986, the disclosure of which is incorporated herein by reference.

The components are present in the liquid electrostatic developer in the indicated amounts.

Nonpolar liquid: 79 to 99.7% by weight, preferably 97.2 to 99.6% by weight;

Thermoplastic resin: 0.25 to 15.0% by weight, preferably 0.25 to 2.5% by weight;

Pigment: 0.1 to 60% by weight of resin preferably 2 to 30% by weight of resin, all weights, except where indicated, are based on the total weight of the developer.

INDUSTRIAL APPLICABILITY

The process of this invention provides improved liquid electrostatic developer containing dispersed electrostatic toner particles. The pigment present in the liquid electrostatic developer is prepared using a flushing method which utilizes a water insoluble vehicle without need to add solvent for the water insoluble vehicle. The flushed pigment is added directly into the electrostatic developer. The pigment does not aggregate and the preparation of the dispersion is simplified, particularly if the water insoluble vehicle is the same as the toner resin, and maximum color strength from the toner particles is achieved rapidly. Images formed from the developers have substantially reduced squash or shrinkage, higher resolution and solid areas have excellent uniformity of appearance and density compared to images formed from liquid developers prepared without the flushing method. Efficiency of transfer from the latent electrostatic image to a carrier sheet is also generally improved. The toner particles preferably having fibers integrally extending therefrom are able to become entangled or entwined with one another.

The liquid electrostatic developers of the invention are useful in copying, e.g., making colored office copies; and color proofing, e.g., a reproduction of an image using colors such as yellow, cyan and magenta. In copying and proofing the electrostatic toner particles are applied to a latent electrostatic image. Other uses for the developer include: digital color proofing, lithographic printing plates and resists.

EXAMPLES

In the following Procedures and Examples, which illustrate but do not limit the invention, the percentages are by weight. The average particle size by area was monitored and determined by a Horiba CAPA-500 centrifugal particle analyzer or Malvern 3600E Particle Sizer (Malvern, Southborough, MA) as described above. lp/mm means line pairs/mm. The melt indices were determined by ASTM D 1238, Procedure A, the density was measured using a Macbeth densitometer model RD918, transfer efficiency is determined as follows: a toned electrostatic image is transferred from the photoreceptor in the copier to a paper carrier sheet. A transparent adhesive tape is applied over the residual toned electrostatic image on the photoreceptor and the residual image is removed with the tape and placed on the previously imaged carrier sheet adjacent to (but not contacting) the transferred image. The density of both images is measured with a densitometer as previously described. The transfer efficiency is the percentage value obtained by dividing the density of the transferred image by the sum of the densities of the transferred and residual images.

PROCEDURE 1

In a water cooled sigma blade mixer, 700 g water wet blue presscake (28.4% solids) Heucophthal Blue® XBT-585-P, Heubach, Inc., Newark, NJ, were mixed with 50 g of Isopar®-M dispersant nonpolar liquid having a Kauri-butanol value of 27, Exxon Corporation. While mixing continued, an additional 50 g of Isopar®-M was added. When an additional 25 g portion of Isopar®-M were added during continued mixing, a breakout of water was observed in which the nonpolar liquid flushed out water from the presscake. The mixer was stopped and the water was poured off with 338 g being collected. To remove more water, 220 g of Isopar®-M were mixed into the pigment dispersion. The mixer was attached to a vacuum system through a dry ice cooled trap. The mixer was heated with steam to distill the water. In the trap, 76 g water and 31.5 g Isopar®-M were collected. The 31.5 g of Isopar®-M were added back into the dispersion along with 75 g fresh Isopar®-M to provide a reasonable consistency pigment dispersion, after being blended until smooth. A theoretical percent solids for the pigment dispersion was 33.3% whereas the measured value was 33.45%.

PROCEDURE 2

In the water cooled Baker-Perkins mixer as described in Procedure 1, 700 g wet blue presscake also as described therein were mixed with 50 g of Aromatic 100, a high purity aromatic solvent having a Kauri-butanol value of 91, Exxon Corporation. While stirring continued, three 25 g portions of Aromatic 100 were added with a sharp breakout of water being observed. The water layer was poured off; 416 g were collected and an unknown amount was spilled. Then 275 g additional Aromatic 100 were added to the pigment and mixed until smooth. Under vacuum conditions and steam heating, 27 g of water and 77 g of Aromatic 100 were collected in a dry ice cooled trap. The 77 g of Aromatic 100 were added back along with 50 g of additional Aromatic 100 and stirred together. Under vacuum a second stripping produced 19 g of water and 18 g Aromatic 100 in the dry ice trap. Fresh Aromatic 100 was added to the dispersion and stirred until smooth. The theoretical percent solids was 30.65 and the actual determination gave 33.9%.

PROCEDURE 3

In the water cooled Baker-Perkins mixer previously described, 600 g wet yellow presscake (29.4% solids) Dalamar® Yellow YT-839-P from Heubach Inc., Newark, NJ were mixed with 25 g portions of Isopar®-M up to a total of 225 g. Some water breakout was observed but not a large amount. With continued mixing, 25 g of Isopar® were added and water was readsorbed indicating that too much hydrocarbon had been added. An additional 125 g of Isopar®-M were added and the system placed under vacuum to strip off the lower boiling water. Isopar®-M distilled during this step was replaced with a like amount of fresh Isopar®-M. 150 g of Isopar®-M were added with stirring to produce a smooth dispersion of 25.1% solids. This procedure illustrates the greater difficulty of separation of the yellow pigment as compared to the blue pigment in Procedures 1 and 2.

PROCEDURE 4

In the water cooled Baker-Perkins mixer previously described, 450 g of wet Quindo® magenta presscake RV-6831 from Mobay/Harmon, Haledon, NJ were mixed with 100 g of Nujol® mineral oil. Four successive 50 g portions of Nujol® mineral oil were added without observing a definite water breakout, however, water was observed to condense on the walls of the mixer as an indication that phase transfer was occurring in the pigment dispersion. Nujol® additions continued until a total of 420 g had been added. Water was removed by vacuum stripping while heating the mixture with steam and 276 g of water were collected in the dry ice trap. After cooling down, the vacuum was broken and the pigment dispersion was collected into a jar.

EXAMPLE 1

A Union Process Model 1-S attritor, Union Process Company, Akron, Ohio, charged with 3/16 inch (4.76 mm) carbon steel balls and having a shaft setting of 9/16 inch (1.43 cm) from the bottom of the mix can, which was jacketed and could be heated with steam or cooled by tap water was used to prepare the developer. The attritor was charged with 200 g of copolymer of ethylene (89%) and methacrylic acid (11%), having a melt index at 190° C. of 100 and an Acid No. of 66; 45 g of the pigment prepared in Procedure 1 and 1000 g Isopar®-H nonpolar liquid having a Kauri-butanol value of 27. The attritor was heated with steam during 2 hours of operation at 240 rpm; then the attritor was cooled with tap water, 700 g of additional Isopar®-H were added, and grinding was continued for 6½ at 340 rpm until the mean particle size was 0.95 μm. The blue toner concentrate was passed through a 240 mesh sieve. The toner was combined with Isopar®-H to produce 1900 g of a 2% solids liquid developer. The developer was charged by adding 24.6 mg of Basic Barium Petronate® per gram of developer solids.

EXAMPLE 2

Example 1 was repeated using the pigment of Procedure 4 with 4 hours of hot dispensing and 26 hours of grinding with tap water cooling. A magenta toner concentrate was prepared. This was diluted to 2% solids liquid developer with Isopar®-H. The developer was charged by adding 92 mg of Basic Barium Petronate® per gram of developer solids.

EXAMPLE 3

Example 1 was repeated using the pigment of Procedure 3 with 15 minutes of hot dispersing and 2 hours of grinding with tap water cooling. A yellow toner concentrate was prepared. This was diluted to 2% solids liquid developer with Isopar®-H. The developer was charged by adding 47 mg of Basic Barium Petronate® per gram of developer solids.

EXAMPLE 4

Example 1 was repeated using the pigment of Procedure 2 with 4 hours of hot dispersing and 11½ hours of grinding with tap water cooling. A blue toner concentrate was prepared. This was diluted to 2% solids liquid developer with Isopar®-H. The developer was charged by adding 44 mg of Basic Barium Petronate® per gram of developer solids.

The liquid developers prepared as described in Examples 1 to 4 were individually tested in a Savin 870 copier at standard mode: charging corona 6.8 kV and transfer corona set at 8.0 kV using as carrier sheets Plainwell offset enamel paper number 3 class, 60 lb. text. Serving as controls, were liquid developers prepared by grinding dry pigments as described in Controls 1, 2 and 3. Comparative results are shown in Table 1 below.

CONTROL 1

An attritor as described in Example 1 was charged with 15.03 g of Heucophthal® Blue XBT-583D, Heubach, Inc., Newark, NJ, 200 g of the copolymer described in Example 1 and 1000 g of Isopar®-L, and agitated for 2 hours in the steam heated attritor as described in Example 1. The attritor was cooled with tap water and 700 g of Isopar®-H was added, and the mixture was ground with tap water cooling for 6.5 hours, at which time the average particle size was 1.34 μm. The toner concentrate was diluted to 2% solids with additional Isopar®-H and was charged to 15 pmhos/cm by the addition of 30 mg of Basic Barium Petronate®/g of toner solids. The toner was then tested in a Savin copier as described in the procedure following Example 4.

CONTROL 2

An attritor as described in Example 1 was charged with 200 g of the copolymer described in Example 1, 18.67 g of Quindo® Magenta RV-6803 (Mobay/Harmon, Haledon, NJ) and 1000 g of Isopar®-L. The attritor was heated with steam and the mixture agitated as described in Example 1 for 4 hours. The attritor was cooled with tap water and 700 g of Isopar®-H were added. The mixture was ground with tap water cooling for 26 hours, at which time the mean particle size was 1.17 μm. The toner concentrate was removed from the attritor. The concentrate was diluted to 2% solids with Isopar®-H. Basic Barium Petronate®, was added until the BULK conductivity of the toner was 95 pmhos/cm. The toner was then tested in a Savin copier as described in the procedure following Example 4.

CONTROL 3

A yellow toner was prepared in the same way as described in Controls 1 and 2, using 4.5 g of Dalamar® Yellow YT-858D, Heuback, Inc., Newark, NJ, hot dispersion for 15 minutes, and cold grind for 3.5 hours. The toner concentrate was diluted to 2% with additional Isopar®-H and was charged to 36 pmhos/cm by adding 60 mg of Basic Barium Petronate®/g of toner solids. The toner was then tested in a Savin copier as described in the procedure following Example 4.

TABLE 1

| Examle or Control | Conduc-* tivity BULK | Image Resolution (lines/mm) | Image Transfer Efficiency | Comment |
|---|---|---|---|---|
| Control 1 (Blue) | 15 | 7 | 82 | |
| Control 2 (Magenta) | 95 | 9 | 95 | fine lines missing |
| Control 3 (Yellow) | 36 | 8 | 78 | fine lines missing |
| Ex. 1 (Blue) | 15 | 9 | 80 | |
| Ex. 2 (Magenta) | 92 | 9 | 100 | |
| Ex. 3 (Yellow) | 35 | 10 | 86 | |
| Ex. 4 (Blue) | 42 | 7 | 100 | |

*Conductivities are measured in picomhos (pmhos)/cm at 5 hertz and 5.0 volts.

These results show the advantages of improved resolution and transfer efficiency when comparing developers of same color vs. controls.

CONTROL 4

200 g of the copolymer described in Example 1, 15.05 of a dry pigment SUN Green Shade Phthalo Blue L49-0714, Sun Chemical Co., Cincinnati, OH, and 1000 g of Isopar®-L were placed in the attritor described in Example 1. The attritor was heated to 100° C. with steam and the mixture agitated at 240 rpm for 2 hours. The attritor was then cooled to room temperature, and 700 g of Isopar®-H were added. The mixture was then ground for 7 hours at 340 rpm with cold water cooling. The material was discharged and washed from the attritor with additional Isopar®-H to give a toner concentrate with 7.35% solids. The toner had the following average particle size: 1.30 μm, 9.8% greater than 3.0 μm and none greater than 10.0 μm.

The concentrate was diluted to 2% solids with Isopar®-H to form a suspension. Two kg of this suspension was then charged with 37.5 mg of lecithin (Fisher Chemical)/gram of toner solids. Additionally, 37.5 mg of triisopropanol amine/gram of toner solids were added. The toner was tnen evaluated in a Savin 870 office copier, standard mode, as described in the procedure following Example 4, using 60 pound enamel coated paper as described. This toner had a transfer efficiency of 83% and showed resolution of 2 lp/mm. The transferred images were marred by several defects, including severe squash and no fine line definition.

EXAMPLE 5

185 g of a copolymer of ethylene (89%) and methacrylic acid (11%) described in Example 1, 30.1 g of a 50% polyethylene/pigment flush, a green shade phthalo blue pigment, Sunfast® Blue 249-1282, Sun Chemical Co., Cincinnati, OH, and 1000 g of Isopar®-L, nonpolar liquid having a Kauri-butanol value of 27, Exxon Corporation, were placed in a Union Process 1-S attritor described in Example 1. The attritor was heated to 100° C. with steam and the mixture agitated at 240 rpm for 2 hours. The attritor was then cooled to room temperature, and 700 g of Isopar®-H were added. The mixture was then ground for 5.5 hours at 340 rpm with cold water cooling. The mixture was discharged and washed from the attritor with additional Isopar®-H to give a toner concentrate with 7.02% solids. The toner had the following average particle size: 1.39 μm, 6.4% greater than 3.0 μm and none greater than 10.0 μm.

The concentrate was diluted to 2% solids with Isopar®-H to form a suspension. Two kg of this suspension was then charged with 59.4 mg of lecithin (Fisher Chemical)/gram of toner solids. Additionally, 37.5 mg of triisopropanol amine/gram of toner solids were added. The toner was then evaluated in a Savin 870 office copier, standard mode, as described in the procedure following Example 4, using 60 pound enamel coated paper as described. This toner had a transfer efficiency of 83% and showed resolution of 8 lp/mm. The transferred images showed much improved resolution over images made with the toner of Control 4.

EXAMPLE 6

200 g of the copolymer described in Example 1, 47 g of a cyan pigment flush E49-2327, 32% flush in mineral oil, Sun Chemical Co., Cincinnati, OH, and 1000 g Isopar®-L were placed in the attritor described in Example 1. The attritor was heated to 100° C. with steam and the mixture agitated at 240 rpm for 2 hours. The attritor was then cooled to room temperature, and 700 g of Isopar®-H were added. The mixture was then ground for 10 hours at 340 rpm with cold water cooling. The material was discharged and washed from the attritor with additional Isopar®-H to give a toner concentrate with 8.07% solids. The toner had the following average particle size: 1.39 μm, 7.8% greater than 3.0 μm and 2.7% greater than 10.0 μm.

The concentrate was diluted to 2% solids with Isopar®-H to form a suspension. Two kg of this suspension were then charged with 40.6 mg of lecithin (Fisher Chemical)/gram of toner solids. Additionally, 37.5 of triisopropanol amine/gram of toner solids were added. The toner was then evaluated in a Savin 870 office copier, standard mode, as described in the procedure following Example 4, using 60 pound enamel coated paper as described. This toner had a transfer efficiency of 100% and showed resolution of 9 lp/mm. The transferred images did not exhibit the disadvantages of the toner of Control 4.

CONTROL 5

The following ingredients were placed in a Union Process 1S Attritor, Union Process Company, Akron, OH:

| Ingredients | Amount (g) |
|---|---|
| Copolymer of ethylene (89%) and methacrylic acid (11%): melt index at 190° C. is 100, acid number is 66 | 200.0 |
| Yellow 14 AAOT 274-3954, (Sun Chem. Co.) | 22.73 |
| Aluminum Stearate #132, Witco Chemical Corporation, New York, NY | 4.55 |
| Isopar®-L, Exxon Corp. | 700.0 |

The ingredients were heated to 90° C. to 110° C. and milled at a rotor speed of 230 rpm with 0.1875 inch (4.76 mm) diameter stainless steel balls for 2 hours. The attritor was cooled to 42° C. to 50° C. while milling was continued and then 1000 grams of Isopar®-L (Exxon Corp.) were added. Milling was continued and the average particle size was monitored. Particle size measured with the Malvern was 7.1 μm corresponding to a 5 hour cold grind. The particulate media were removed and the toner was diluted to 2% solids with additional Isopar®-L and charged with 90 mg Basic Barium Petronate®/g of toner solids. Image quality was determined using a Savin 870 copier in a standard mode as described in the procedure following Example 4, using 60 pound enamel coated paper as described. Image quality was good with copier limited resolution, good solids, and low squash. The copy also had low transfer efficiency. Results are shown in Table 2 below.

CONTROL 6

The procedure for Control 5 was repeated with the following exceptions: the toner was diluted to 1.5% solids and charged with 39 mg Basic Barium Petronate®/g of toner solids.

The developer was evaluated by toning a photopolymer xeroprinting master. A photopolymerizable composition consisting of 57.0% (by weight) poly(styrene-methylmethacrylate), 28.6% ethoxylated trimethylolpropane triacrylate, 10.6% 2. 2',4,4'-tetrakis(o-chlorophenyl)-5,5'-bis(m,p-dimethoxyphenyl)-biimidazole, and 3.8% 2-mercaptobenzoxazole coated on an 0.004 inch (0.01 cm) aluminized polyethylene terephthalate film substrate. A 0.00075 inch (0.0019 cm) polypropylene cover sheet was laminated to the dried photopolymerizable layer. The photopolymerizable element was exposed imagewise through a halftone negative film with its emulsion side in contact with the cover sheet, using a Douthitt Option X exposure unit (Douthitt Corp., Detroit, MI), equipped with a model TU 64 Violux®5002 lamp assembly (Exposure Systems Corp., Bridgeport, CT) and a photopolymer type 5027 lamp. The cover sheet was then removed. For evaluation of the charged developers, the film was charged positively by passing over a 5.1 kV scorotron at 2 inches (5.08 cm)/sec. The toned image was then transferred to Solitare enamel paper with a positive transfer corona of 4.0 kV at 2 inches (5.08 cm)/sec. Image quality was good with 1%-95% dots but solids and lines showed trailing edge smearing. Results are shown in Table 2 below.

EXAMPLE 7

The procedure for Control 5 was repeated with the following exceptions: instead of the 23.74 grams of Yellow 14 Color Standard pigment, 51.28 grams of Polyethylene Flush Yellow 14 AAOT L74-1357, Sun Chem. Co. (50% polyethylene/pigment flush) were used. In addition, 5.13 grams of aluminum stearate were used instead of the 4.55 grams. The toner was cold ground for 5.25 hours with resulting Malvern particle size of 6.5 μm. Image quality was the same as Control 1 but with improved transfer efficiency. Results are found in Table 2 below.

EXAMPLE 8

The procedure for Example 7 was repeated with the following exceptions: the toner was cold ground for 5.25 hours with resulting Malvern particle size of 7.3 μm. The toner was diluted and charged as in Control 6. Image evaluation was performed as described in Control 6. Image quality was improved compared to Control 6 with improved dot range, 1-97% and reduced trailing edge smear. Results are found in Table 2 below.

TABLE 2

| Toner | Pigment | Evaluation | Resolution | Squash | Transfer Effic. |
|---|---|---|---|---|---|
| C5 | Color Std. | Savin 870 | 11-12 lp/mm | Good | 80% |
| C6 | Color Std. | Photopolymer | 1-95% dots | Good | — |
| Ex. 7 | PE Flush | Savin 870 | 11-12 lp/mm | Good | 92% |
| Ex. 8 | PE Flush | Photopolymer | 1-97% dots | V. good | — |

We claim:

1. A process for preparing an improved liquid electrostatic developer containing electrostatic toner particles comprising:
   (a) mixing intimately a water-wet presscake pigment with at least one water insoluble vehicle in the absence of a solvent for the water insoluble vehicle until water separates from the mixture leaving the pigment dispersed in the water insoluble vehicle;
   (b) removing substantially all the water;
   (c) dispersing at an elevated temperature in a vessel under high shear the pigment dispersion, a thermoplastic resin, a nonpolar liquid having a Kauributanol value of less than 30, the temperature being maintained to plasticize and liquify the resin and below that at which the nonpolar liquid degrades and any component decomposes;
   (d) cooling the dispersion to form resin toner particles having pigment dispersed therein.

2. A process according to claim 1 wherein the water insoluble vehicle is selected from the group consisting of at least one oil, nonaqueous liquid, resin, mixture of oil and nonaqueous liquid, mixture of oil and resin, and mixture of nonaqueous liquid and resin, with the proviso that the oil and nonaqueous liquid are not solvents for the resin.

3. A process according to claim 2 wherein the water insoluble vehicle is at least one oil.

4. A process according to claim 2 wherein the water insoluble vehicle is at least one nonaqueous liquid.

5. A process according to claim 2 wherein the water insoluble vehicle is a mixture of an oil and a nonaqueous liquid.

6. A process according to claim 2 wherein the water insoluble vehicle is at least one resin.

7. A process according to claim 1 wherein the pigment is a colored pigment other than black.

8. A process according to claim 1 wherein the dispersant nonpolar liquid is compatible with the water insoluble vehicle of step (a).

9. A process according to claim 1 wherein the thermoplastic resin is a copolymer of ethylene and an α-β-ethylenically unsaturated acid selected from the group consisting of acrylic acid and methacrylic acid.

10. A process according to claim 1 wherein the thermoplastic resin is polystyrene.

11. A process according to claim 1 wherein the thermoplastic resin is a copolymer of ethylene (80 to 99.9%)/acrylic or methacrylic acid (20 to 0%)/alkyl of acrylic or methacrylic acid where alkyl is 1 to 5 carbon atoms (0 to 20%).

12. A process according to claim 11 wherein the thermoplastic resin is a copolymer of ethylene (89%) and methacrylic acid (11%) having a melt index at 190° C. of 100.

13. A process according to claim 1 wherein during or subsequent to step (c) a nonpolar liquid soluble ionic or zwitterionic compound is added to the dispersion.

14. A process according to claim 13 wherein the ionic or zwitterionic compound is lecithin.

15. A process according to claim 13 wherein the ionic or zwitterionic compound is Basic Barium Petronate.

16. A process according to claim 13 wherein the ionic or zwitterionic compound is present in an amount of 1 to 1000 mg/g of developer solids.

17. A process according to claim 1 wherein the toner particles have an average by area particle size of less than 10 μm.

18. A process according to claim 1 wherein the liquid electrostatic developer contains (a) nonpolar liquid, 79 to 97.7% by weight of developer, (b) thermoplastic resin, 0.25 to 15% by weight of developer and (c) pigment dispersion, 0.1 to 60% by weight of resin (b).

19. A process according to claim 1 wherein the toner particles have a plurality of fibers integrally extending therefrom.

20. A process according to claim 1 wherein the thermoplastic resin particles have dispersed therein a metallic soap.

21. A process according to claim 20 wherein the metallic soap is aluminum stearate.

22. A process according to claim 20 wherein the metallic soap is present in 0.01 to 60% by weight based on the total weight of solids.

23. A process according to claim 1 wherein subsequent to step (c) the mixture is diluted with additional nonpolar liquid.

24. A process according to claim 23 wherein the thermoplastic resin is a copolymer of ethylene (89%) and methacrylic acid (11%) having a melt index at 190° C. of 100.

25. A process according to claim 23 wherein the dilution is conducted to reduce the concentration of toner particles to between 0.1 to 5.0 percent by weight with respect to the nonpolar liquid.

26. A process according to claim 1 wherein an additional compound is present which is an adjuvant taken from the group consisting of polyhydroxy compound, aminoalcohol, polybutylene succinimide and an aromatic hydrocarbon.

27. A process according to claim 26 wherein the adjuvant is a polyhydroxy compound.

28. A process according to claim 26 wherein the adjuvant is an aminoalcohol.

29. A process according to claim 28 where the amino alcohol is triisopropanolamine.

30. A process according to claim 26 wherein the adjuvant is polybutylene succinimide.

31. A process according to claim 26 wherein the adjuvant is an aromatic hydrocarbon.

* * * * *